US005749572A

United States Patent [19]

Fricke et al.

[11] Patent Number: 5,749,572

[45] Date of Patent: May 12, 1998

[54] GRIPPER CONTROL FOR A CYCLICALLY ROCKINGLY DRIVEN PREGRIPPER FOR SINGLE-SHEET TRANSPORT IN A SHEET-FED PRINTING PRESS

[75] Inventors: Andreas Fricke, Eberbach; Heiner Luxem, Wilhelmsfeld; Lothar Stadler, Eppelheim, all of Germany

[73] Assignee: Heidelberger Druckmaschinen AG, Heidelberg, Germany

[21] Appl. No.: 757,543

[22] Filed: Nov. 21, 1996

[30] Foreign Application Priority Data

Nov. 21, 1995 [DE] Germany ..... 195 43 381.5

[51] Int. Cl.[6] ..... B65H 5/12

[52] U.S. Cl. ..... 271/268; 271/277; 271/85; 101/409; 101/410

[58] Field of Search ..... 101/408, 409, 101/410; 271/277, 85, 82, 268

[56] References Cited

U.S. PATENT DOCUMENTS

| | | | |
|---|---|---|---|
| 5,343,806 | 9/1994 | Fricke et al. . | |
| 5,398,607 | 3/1995 | Fricke et al. | 271/277 |
| 5,440,983 | 8/1995 | Dopke et al. | 101/410 |
| 5,562,035 | 10/1996 | Pollich et al. | 101/410 |
| 5,570,635 | 11/1996 | Stadler | 271/277 |

FOREIGN PATENT DOCUMENTS

| | | |
|---|---|---|
| 0 361 105 A1 | 4/1990 | European Pat. Off. . |
| 35 36 535 | 6/1986 | Germany . |
| 43 30 392 | 3/1995 | Germany . |
| 2 015 483 | 9/1979 | United Kingdom . |

*Primary Examiner*—H. Grant Skaggs
*Attorney, Agent, or Firm*—Herbert L. Lerner; Laurence A. Greenberg

[57] ABSTRACT

Gripper control for a cyclically rockingly driven pregripper for single-sheet feeding in a sheet-fed printing press, the pregripper being disposed at a free end of a rocker lever, which is swivelable about a rocker shaft fixed to a frame of the printing press, and having at least one sheet gripper forcibly movable by cams about an articulated shaft disposed parallel to the rocker shaft, for closing and opening the sheet gripper when the sheet is taken over and transferred, respectively, one of the cams being revolvable a single revolution, and another of the cams being disposed on a locally stationarily swivelable roller lever carrying a cam roller engaging with the one cam, the other cam being swivelable cyclically in the position thereof, the position of the cams determining the closing time and opening time of the gripper, includes an indexing mechanism for fixing the other cam on the locally stationarily swivelable roller lever, the other cam having a first gripper-closing cam region and a first gripper-opening cam region, the first gripper-closing cam region having a second gripper-opening cam region, the one cam revolvable a single revolution having a second gripper-closing cam region operatively associated with the second gripper-opening cam region for compensation.

3 Claims, 1 Drawing Sheet

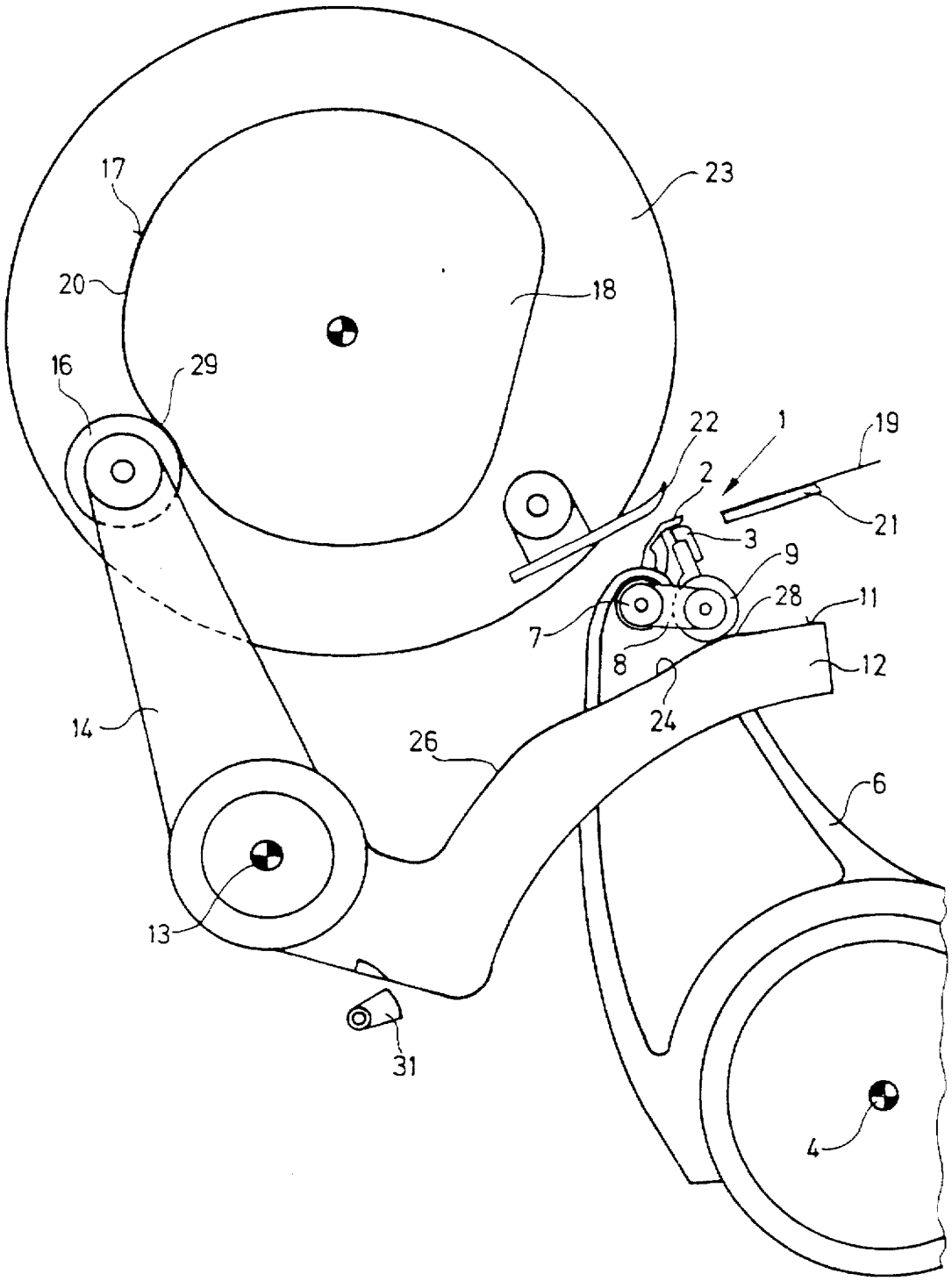
17
23
20
18
16
29
22
1
19
2
21
3
9
28
11
7
8
12
24
14
26
6
13
31
4

GRIPPER CONTROL FOR A CYCLICALLY ROCKINGLY DRIVEN PREGRIPPER FOR SINGLE-SHEET TRANSPORT IN A SHEET-FED PRINTING PRESS

BACKGROUND OF THE INVENTION

Field of the Invention

The invention relates to a gripper control for a cyclically rockingly driven pregripper for single-sheet transport in a sheet-fed printing press.

From the published German Patent Document DE 43 30 392 Al, it has become known to provide at least one sheet gripper at a free end of a pregripper having a rocking lever which is swivelable about a rocker shaft fixed to a frame. An articulated shaft disposed parallel to the rocker shaft is provided for closing and opening the sheet gripper. A single-revolution cam and a locally fixed swivelable cam with a roller lever having a cam roller engaging the single-revolution cam cyclically swivel the locally fixed cam into the position thereof. The positions of the cams determine the opening and closing times of the gripper.

If mis-fed sheets, i.e., skewed sheets or multiple sheets, are present at a sheet transfer or takeover location on a feeder table, these mis-fed sheets must not be transported by the gripper and surrendered to the following cylinder.

SUMMARY OF THE INVENTION

It is accordingly an object of the invention to provide a gripper control for a cyclically rockingly driven pregripper for single-sheet feeding in a sheet-fed printing press which reliably prevents mis-fed sheets from being transported by the gripper of the respective pregripper and from being advanced to the following cylinder.

With the foregoing and other objects in view, there is provided, in accordance with the invention, a gripper control for a cyclically rockingly driven pregripper for single-sheet feeding in a sheet-fed printing press, the pregripper being disposed at a free end of a rocker lever, which is swivelable about a rocker shaft fixed to a frame of the printing press, and having at least one sheet gripper forcibly movable by cams about an articulated shaft disposed parallel to the rocker shaft, for closing and opening the sheet gripper when the sheet is taken over and transferred, respectively, one of the cams being revolvable a single revolution, and another of the cams being disposed on a locally stationarily swivelable roller lever carrying a cam roller engaging with the one cam, the other cam being swivelable cyclically in the position thereof, the position of the cams determining the closing time and opening time of the gripper, comprising an indexing mechanism for fixing the other cam on the locally stationarily swivelable roller lever, the other cam having a first gripper-closing cam region and a first gripper-opening cam region, the first gripper-closing cam region having a second gripper-opening cam region, the one cam revolvable a single revolution having a second gripper-closing cam region operatively associated with the second gripper-opening cam region for compensation.

In accordance with another feature of the invention, the second gripper-opening cam region is an opening cam, and the second gripper-closing cam region is a control trough.

In accordance with a concomitant feature of the invention, the at least one sheet gripper includes a gripper prong and a gripper pad having a spacing therebetween producible by the gripper-opening cams, the spacing being greater than a spacing between the gripper prong and the gripper pad in an opened position of the pregripper gripper at a feeder table.

Advantageously, an indexing mechanism in the form of a detent-lockable latch is provided, which fixes the gripper-opening/closing cam in a gripper-opening position, so that the gripper during its rocking transport movement remains open and thus does not transport any sheets.

To prevent multiple sheets, which have become clamped between the gripper prong and the gripper pad without any closing motion thereof, from being transported, an added gripper-opening cam region is disposed in the gripper-closing cam region of the cam segment, i.e., the other cam. By this advantageous provision, the gripper, in the afore-described case, is opened beyond the extent that it was open at the sheet transfer location at the feeder table, so that any multiple sheets which may possibly be clamped in place are loosened and released. To prevent an undesired opening of the grippers in the gripper-closing cam region of the added gripper-opening cam region during normal operation, a gripper-closing cam region is provided on the control contour of the single-revolution revolving cam to compensate for the added gripper-opening cam region of the cam segment.

Other features which are considered as characteristic for the invention are set forth in the appended claims.

Although the invention is illustrated and described herein as embodied in a gripper control for a cyclically rockingly driven pregripper for a single-sheet transport in a sheet-fed rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single FIGURE of a drawing, wherein:

BRIEF DESCRIPTION OF THE DRAWING

The single FIGURE of the drawing is a diagrammatic side elevational view of the gripper control.

DESCRIPTION OF THE PREFERRED EMBODIMENTS

Referring now to the single FIGURE of the drawing, there is shown therein a pregripper gripper 1 of a sheet-fed printing press having a gripper prong or finger 2 and a gripper pad or support 3, the gripper 1 being disposed at an end of a rocking lever 6 driven cyclically to rock or oscillate about a rocker shaft 4. The pregripper gripper 1 has an articulated shaft 7, whereon the gripper prong 2 is secured, and a lever 8 which swivels the articulated shaft 7. The lever 8 is provided at one end thereof with a rotatably supported segment roller 9, which is in operating engagement with a control contour 11 of a cam segment 12. The cam segment 12 is supported so as to be swivelable about a swivel point 13 which is fixed to the press frame. A roller lever 14 connected to the cam segment 12 has a rotatably disposed cam roller 16 on a free end thereof, the cam roller 16 being in operative engagement with the control contour 17 of a control cam 18 revolving with a single revolution.

A sheet 19 to be transported is taken over, during operation, by the pregripper gripper 1 at a feeder table 21, and transferred to a gripper 22 of a following cylinder 23.

A so-called "opened" position of the grippers 2 at the feeder table 21 is attainable by providing for the control contour 11 of the cam segment 12 to be pivoted counter-clockwise into the "opened" position. Gripper closure is determined by a closing region 20 of the control cam 18. The cam segment 12 is deflected to such an extent about the swivel point 13 that the gripper 2 is closed by the segment roller 9 and the control contour 11.

From this position, the rocking lever 6 swivels about the rocker shaft 4 into a transfer position, wherein the sheet 19 is transferred or surrendered to the gripper 22 of the following cylinder 23. In this regard, via a closing region 24 of the cam segment 12, the segment roller 9 is moved to an opening region 26 of the cam segment 12. The closing region 24 additionally has an opening cam 28.

When sheet transport is unimpeded, i.e., no mis-fed sheets are present, the action of this opening cam 28 is compensated for by the provision of a control trough or dip 29 on the control contour 17 of the cam 18.

If mis-fed sheets are reported, a swivelably supported indexing latch or pawl 31 fixes or locks the cam segment 13 in an "opened" position of the pregripper gripper 1.

By this provision, the gripper prong 2 is kept "opened", and further sheet transport is effectively prevented. If the segment roller 9 reaches the region of the opening cam 28, the gripper prong 2 remains raised relative to the gripper support 3 by a distance which is slightly above the standard opening distance; that is, in the opening region wherein the segment roller 9 is in operating engagement with the opening cam 28, the space between the gripper prong 2 and the gripper pad 3 is greater than the space between the gripper prong 2 and the gripper pad 3 in the "opened" state at the feeder table 21. Due to this provision, multiple sheets, which would otherwise be transported, for example, without a closing motion of the pregripper gripper 1, can be reliably released.

We claim:

1. Gripper control for a cyclically rockingly driven pregripper for single-sheet feeding in a sheet-fed printing press, the pregripper being disposed at a free end of a rocker lever, which is swivelable about a rocker shaft fixed to a frame of the printing press, and having at least one sheet gripper forcibly movable by cams about an articulated shaft disposed parallel to the rocker shaft, for closing and opening the sheet gripper when the sheet is taken over and transferred, respectively, one of the cams being revolvable a single revolution, and another of the cams being disposed on a locally stationarily swivelable roller lever carrying a cam roller engaging with the one cam, the other cam being swivelable cyclically in the position thereof, the position of the cams determining the closing time and opening time of the gripper, comprising an indexing mechanism for fixing the other cam on the locally stationarily swivelable roller lever, the other cam having a first gripper-closing cam region and a first gripper-opening cam region, said first gripper-closing cam region having a second gripper-opening cam region, the one cam revolvable a single revolution having a second gripper-closing cam region operatively associated with the second gripper-opening cam region for compensation.

2. Gripper control according to claim 1, wherein said second gripper-opening cam region is an opening cam, and said second gripper-closing cam region is a control trough.

3. Gripper control according to claim 1, wherein said at least one sheet gripper includes a gripper prong and a gripper pad having a spacing therebetween producible by said gripper-opening cams, said spacing being greater than a spacing between said gripper prong and said gripper pad in an opened position of the pregripper gripper at a feeder table.

* * * * *